US008434449B2

(12) United States Patent
Schneeberger

(10) Patent No.: US 8,434,449 B2
(45) Date of Patent: May 7, 2013

(54) ROTARY PISTON DEVICE HAVING INTERWINED DUAL LINKED AND UNDULATING ROTATING PISTONS

(76) Inventor: Johannes Peter Schneeberger, Brisbane, CA (US)

( * ) Notice: Subject to any disclaimer, the term of this patent is extended or adjusted under 35 U.S.C. 154(b) by 907 days.

(21) Appl. No.: 12/534,815

(22) Filed: Aug. 3, 2009

(65) Prior Publication Data

US 2011/0027113 A1 Feb. 3, 2011

(51) Int. Cl.
*F02B 53/00* (2006.01)

(52) U.S. Cl.
USPC ..... 123/241; 123/43 B; 123/245; 123/18 R; 123/18 A; 418/35; 418/36; 418/37

(58) Field of Classification Search ..... 123/241, 123/43 B, 245, 18 R, 18 A; 418/35–38
See application file for complete search history.

(56) References Cited

U.S. PATENT DOCUMENTS 1,729,242 A * 9/1929 Bregere ..... 123/43 B
2,132,595 A * 10/1938 Bancroft ..... 123/559.1
3,227,090 A * 1/1966 Bartolozzi ..... 123/245
3,256,866 A * 6/1966 Bauer ..... 123/245
4,068,985 A * 1/1978 Baer ..... 418/36
6,341,590 B1 * 1/2002 Barrera et al. ..... 123/245
6,739,307 B2 5/2004 Morgado
6,880,484 B1 4/2005 Lee
6,886,527 B2 5/2005 Regev
6,895,922 B1 5/2005 Stoughton
6,962,137 B2 11/2005 Udy
7,156,068 B2 1/2007 Yuksel
7,178,502 B2 2/2007 Okulov
7,222,601 B1 5/2007 Kamenov
7,255,086 B2 8/2007 Kovalenko
7,341,041 B2 3/2008 Pekau
7,347,676 B2 3/2008 Kopelowicz
7,364,415 B2 4/2008 Day
7,415,962 B2 8/2008 Reisser
7,431,007 B2 10/2008 Kamath
7,441,534 B2 10/2008 Bastian
7,461,626 B2 12/2008 Kimes
7,849,822 B2 * 12/2010 Yim ..... 123/18 R
7,909,590 B2 * 3/2011 Pomar ..... 123/18 R

* cited by examiner

*Primary Examiner* — Mary A Davis

(57) ABSTRACT

Axially protruding, centrally cooled pistons rotate around a stationary primary rotation axis within a cylindrical piston chamber. The pistons are held on both of their axial ends by concentrically rotating crank disks as intertwined rotary assemblies. On the outside of each crank disk is hinged a driving piston that slides in a radial guide of two flywheels oppositely axially adjacent the piston chamber and crank disks. The flywheels rotate around an offset secondary rotation axis. As a result. The pistons are individually and oppositely alternately accelerated and decelerated. Volumes between them angularly expand and contract. Inlets and outlets are positioned along the piston chamber circumference in correspondence with expansion and contraction phases of the rotating volumes. A low number of moving parts, area sealed volumes, no valves, no dead volume, balanced mass forces, vibration free rotation and short force transmission paths provide for lightweight construction and high rotational speeds.

19 Claims, 19 Drawing Sheets

ROTARY PISTON DEVICE HAVING INTERWINED DUAL LINKED AND UNDULATING ROTATING PISTONS

FIELD OF INVENTION

The present invention relates to pumps, compressors and engines with circumferential undulating, area sealed rotating pistons.

BACKGROUND OF INVENTION

Piston devices are preferably used where a large fluid pressure difference needs to be induced or utilized. Commonly employed linearly oscillating piston pumps, compressors and engines are well known for their mechanical friction losses, fluid friction losses and thermodynamic losses. Mechanical friction losses particularly in engines are attributed to the commonly large number of valves, pistons and their driving and linking mechanisms and the friction in between them. Fluid friction losses occur predominantly across intake and exhaust valves. Thermodynamic losses are contributed by the initial fluid compression taking place in the hot combustion chamber where the working fluid under compression is additionally heated from outside. As the working fluid also heats up internally during its compression, the compression ratio is reduced by the external heating in a gasoline engine by the self ignition temperature of the gasoline vapors. In a diesel engine well known chemical reaction temperatures limit the maximum compression ratio. Thermodynamic efficiency is directly related to compression ratio as is well known in the art. Therefore there exists a need for a piston device that may be utilized as a pump, compressor and/or in a combustion engine and that provides reduced mechanical friction losses due to a reduced number of moving parts, reduced fluid friction losses due to a fluid exchange control without valves and in case of a combustion engine reduced thermodynamic losses due to a compression stage that is structurally separated from combustion heated structures. The present invention addresses these needs.

The concept of a rotating volume that contracts and expands while moving in a loop has been considered in the prior art to provide fluid exchange without valves. The well known Wankel engine is the only mass produced rotating piston combustion engine to date. Despite its compact design without valves, it has the fundamental flaw of a line contact seal that slides along an abruptly changing peripheral surface with high velocity. This limits live time as well as compression ratio. Therefore, there exists a need for a rotating piston engine that provides area sealing in between continuously shaped sealing surfaces for a reliable lasting operation. The present invention addresses also this need.

Other rotating piston engine concepts in the prior art provide work volumes that expand and contract while rotating. On the one hand, these engine concepts fail to address the particular needs for a simple mechanical drive with a low number of joints and the shortest mechanical force transmitting paths that can be designed with sufficient strength and stiffness and yet with minimal moving mass and mass forces. Also it is desirable to have all moving masses at a minimum and substantially balanced to minimize vibration and bearing loads at high rotational speeds. This is one well known prerequisite to drive such devices with sufficiently high rotational speeds in order to obtain a power-to-weight ratio of such an engine that is at least comparable with that of a modern oscillating piston engine. Therefore, there exists a need for a rotating piston device that is mechanically simple with a low number of lightweight moving parts and with substantially balanced rotating masses for high rotational speeds and consequently for a high power-to-weight ratio. The present invention addresses also this need.

On the other hand, to employ a rotary piston device in conjunction with hot combusting fluids, there is a need to provide the pistons particularly with a sufficiently loose connection, cooling and lubrication so that they their thermal expansion and sliding friction may be conveniently controlled. At the same time pistons and other parts contributing in encapsulating the work volumes are desired to have area contact in the sliding seal interfaces. This is another prerequisite for reliable sealing at high pressures, minimized wear and optimized heat transfer in the sliding seal interfaces. The present invention addresses also these needs.

SUMMARY

Preferably two axially protruding rotary pistons are commonly rotationally guided and individually angularly accelerated within a common cylindrical piston chamber. As the rotary pistons individually and alternately accelerate and decelerate during their rotation around a stationary primary rotation axis, work volumes between them angularly expand and contract. Inlets along the piston chamber provide peripheral access of a work fluid to the work volumes as the expanding work volumes pass by the inlets. As the contracting work volumes pass by the outlets, the contained work fluid is vacated into the outlets. Angular position and extension of the inlet(s) and outlet(s) are selected in conjunction with the intended use of the rotary piston device as a pump, compressor or as a motor as may be well appreciated by anyone skilled in the art.

Each rotary piston is part of a rotary assembly that includes crank disks axially coupled to the rotary pistons at both their axial ends. Each crank disk has a crank joint with a tertiary rotation axis fixed with respect to their rotary piston and in a secondary offset to the primary rotation axis. Joined at the crank joints are driving pistons that rotate freely around their respective tertiary rotation axes and, together with their rotary assembly, around the primary rotation axis. Each driving piston in turn is radial free guided in a radial sliding guide of flywheels outward and immediately adjacent to both crank disks. The flywheels with their sliding guides rotate around a stationary secondary rotation axis that is in a primary offset to the primary rotation axis. Due to the primary offset, the driving pistons are forced radial inward and outward in their radial sliding guides as they are rotated by the radial sliding guides around the secondary rotation axis. The changing distance of the driving pistons to the secondary rotation axis results in a varying rotational speed of them together with the joined rotary assemblies around the primary rotation axis while the flywheels rotate at a substantially constant speed. The tertiary rotation axes compensate for a periodically changing angle of the driving pistons relative to their respective rotary assemblies.

The sliding guides of opposite flywheels are aligned with each other and each of them extends preferably continuous across the secondary rotation axis. Driving pistons belonging to separate rotary assemblies are guided in the radial sliding guides on opposite sides of the secondary rotation axis. Thus, the two rotary assemblies and their driving pistons are accelerated and decelerated individually and in an alternating fashion. As a favorable result, the angular mass forces resulting from angular acceleration and deceleration of the two rotary assemblies and their joined driving pistons are substantially cancelled out in the radial sliding guides and have no substantial effect on the continuous rotation of the flywheels.

The driving pistons may be joined with their crank disks diametrically opposite the rotary piston with respect to the primary rotation axis. Consequently, a combined mass center of each rotary assembly and its respective driving pistons may be positioned coinciding with the primary rotation axis. Centrifugal mass forces of individual rotary assembly components and their respective driving pistons may thereby cancel themselves out.

The rotary piston device provides a low number of rotating parts, area sealing interfaces between pistons and their contacting faces, fluid exchange without valves, balanced centrifugal and angular mass forces, short force transmission paths between joined and coupled components of individually opposing mass forces and smooth rotation. As a consequence, the rotary piston device may be operated reliably and efficiently at high rotational speeds, which in turn provide for a high power-to-weight ratio.

The rotary piston device may be part of a combustion engine providing compression of air and/or air/fuel mixture and, in an additional separate stage, a motor that is harvesting pressure energy and, eventually, also the kinetic energy of the pressurized combusted and/or combusting air and/or air fuel mixture. The rotary piston device may also be operated as a pump or motor of incompressible fluid, and/or as a compressor or motor for compressible fluid.

DETAILED DESCRIPTION

Figure 1:
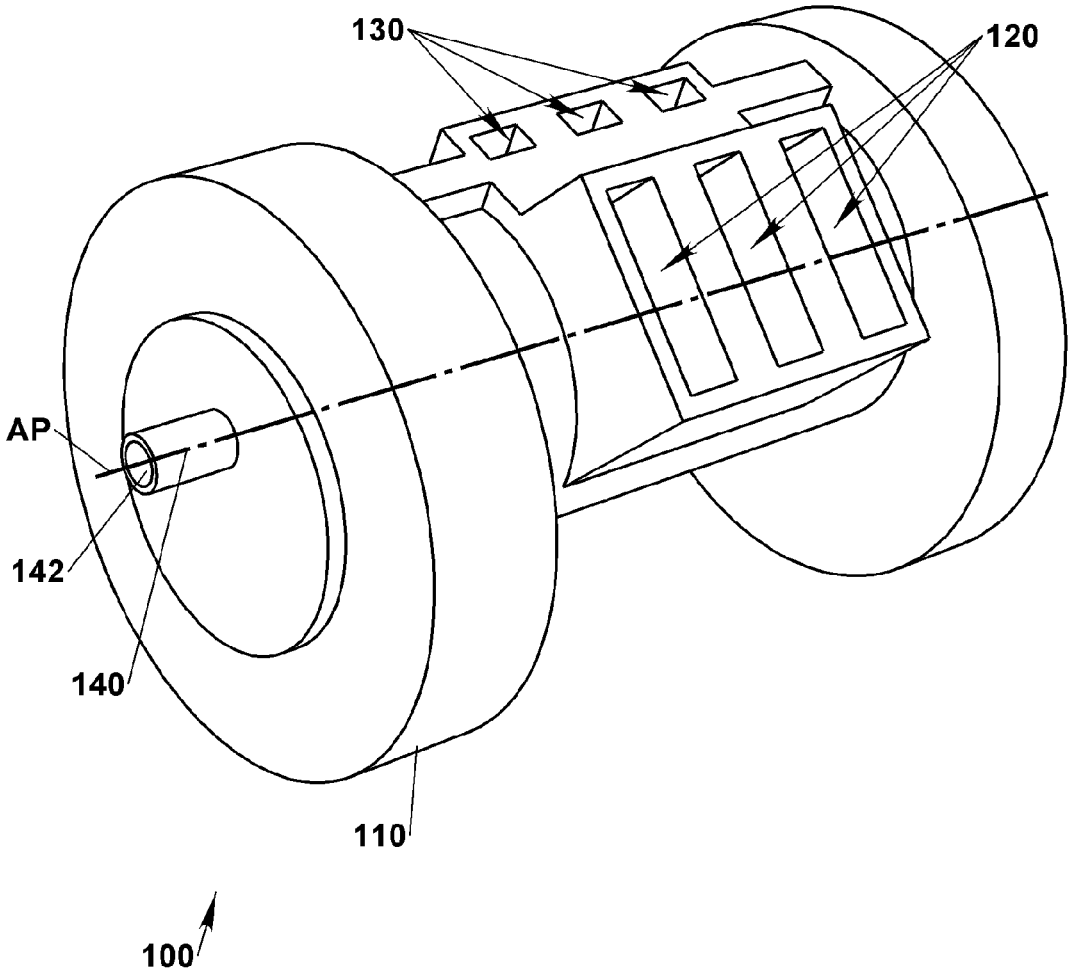
FIG. 1 is a first perspective view of rotary piston device of a first embodiment of the invention.
Figure 2:
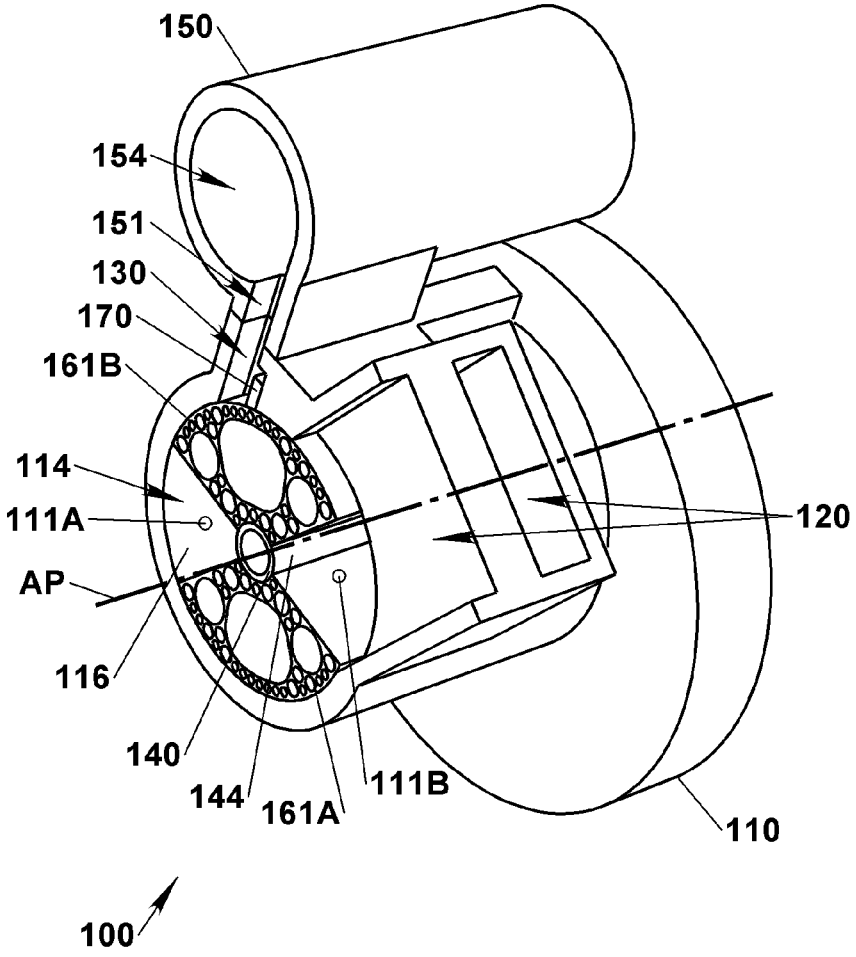
FIG. 2 is the first perspective view of the rotary piston device of FIG. 1 cut along a vertical mid side plane.
Figure 3:
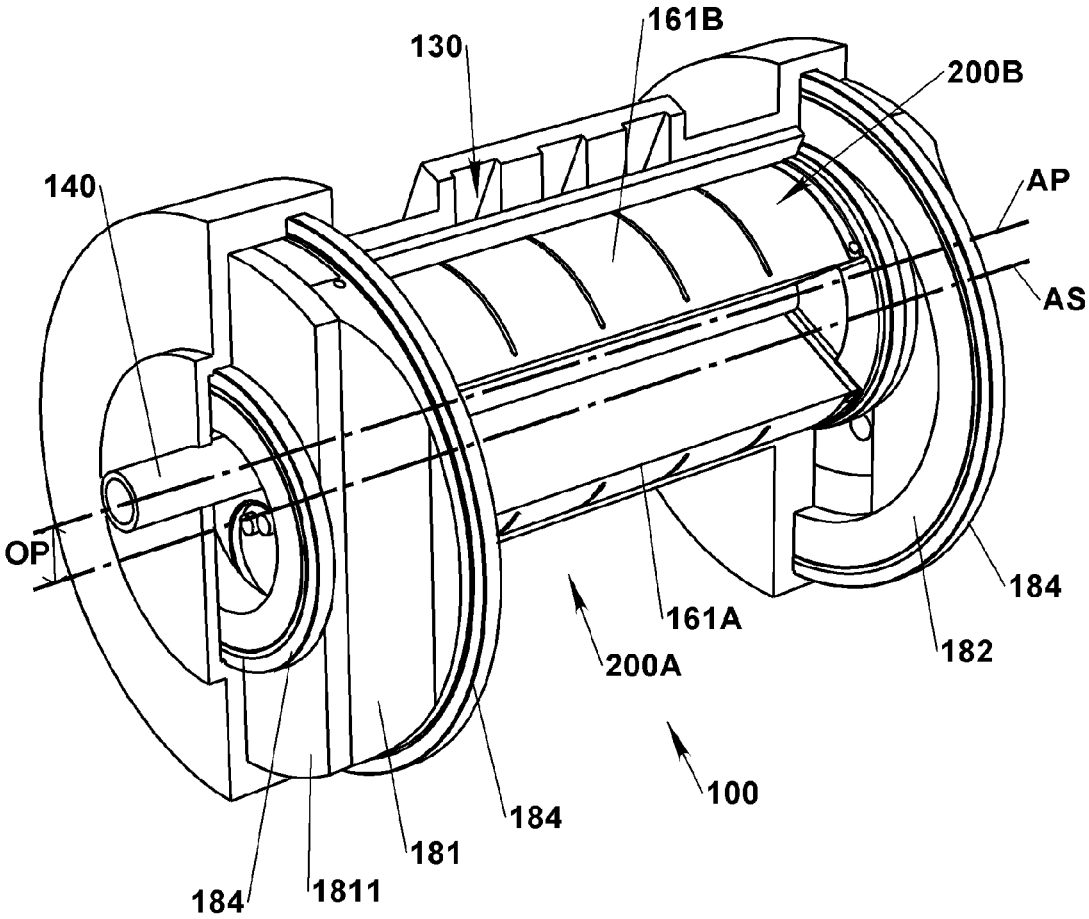
FIG. 3 is the first perspective view of the rotary piston device of FIG. 1 with the housing cut along a vertical mid front plane.
Figure 4:
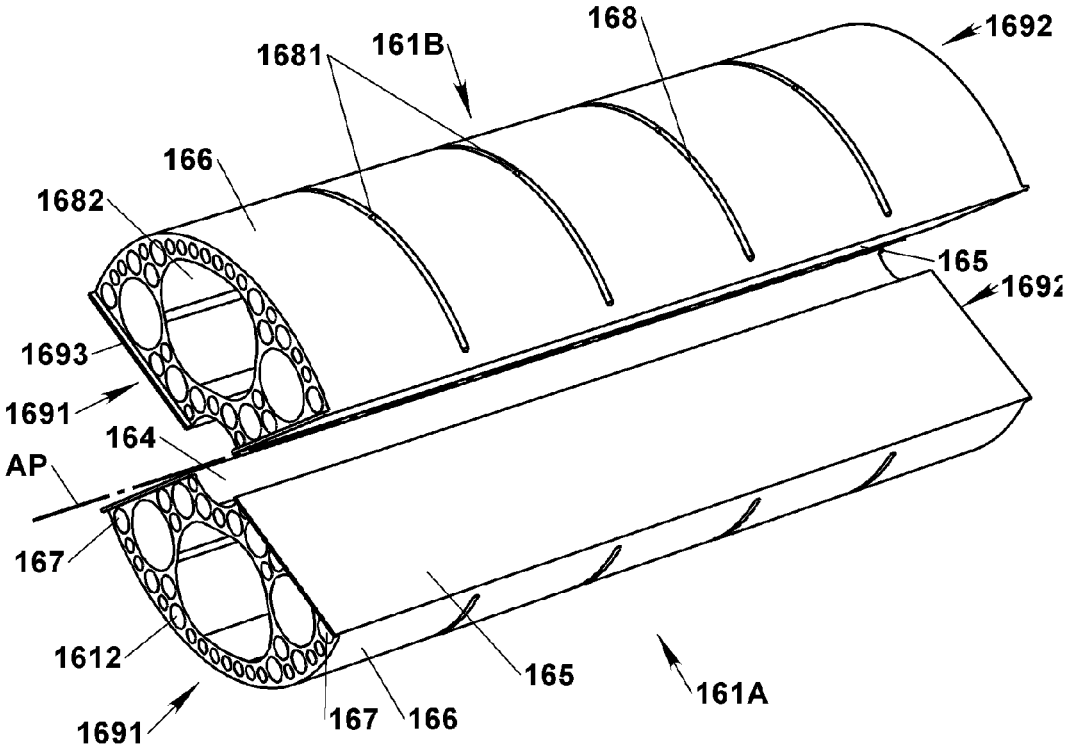
FIG. 4 is the first perspective view of rotary pistons of a first embodiment of the rotary piston device as in FIGS. 1, 2, 3.
Figure 5:
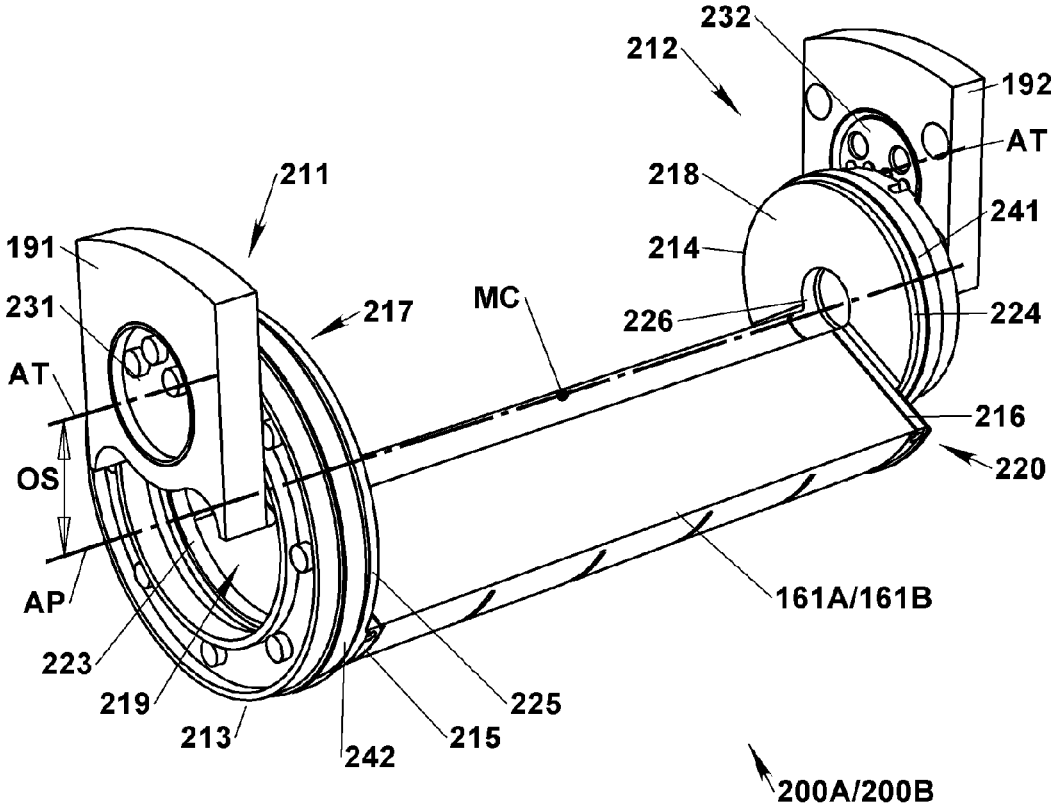
FIG. 5 is the first perspective view of a rotary assembly including one rotary piston of FIG. 4.

As in FIGS. 1-6, a rotary piston device 100 of a first embodiment of the invention includes a housing 110 having inside a primary piston chamber 114. The primary piston chamber 114 is rotationally symmetric with respect to a primary rotation axis AP, which is stationary with respect to the housing 110. The primary piston chamber 114 is preferably cylindrical. Also part of the rotary piston device 100 are preferably two rotary assemblies 200A, 200B suspended concentrically to each other, two opposing flywheels 181, 182, and two opposing driving pistons 191, 192 at each of the rotary assemblies 200A, 200B. The rotary assembly 200A, 200B are rotationally suspended with respect to the primary rotation axis AP within the primary piston chamber 114. Part of each rotary assembly 200 is a rotary piston 161A/161B axially extending along the primary rotation axis AP between two opposing axial piston ends 1691, 1692 and two opposing crank disks 211,212. Each of the crank disks 211/212 has an axial piston coupling 215/216, a crank joint 231/232 and a bearing disk 213/214 that is in between a respective axial piston coupling 215/216 and a respective crank joint 231/232. Each bearing disk 213/214 has a chamber seal face 217/218 that contributes in axially sealing the primary piston chamber 114 and that is in a sliding seal contact with an opposite piston coupling back face 220/219. The axial piston couplings 215, 216 are axially engaging with a respective one of the opposing piston ends 1691/1692 such that torque, fluid pressure on the rotary pistons 161A, 161B as well as mass forces of the rotary pistons 161A, 161B are transferred onto the adjacent crank disks 211, 212 while the rotary pistons 161A, 161B remain preferably axially loose in between the opposing axial piston couplings 215, 216. In that way, the rotary pistons 161A, 161 B may freely axially expand when heated by a compressed and/or combusting fluid in the adjacent work volumes 111A, 111B. Each of the crank joints 231,232 provides a tertiary rotation axis AT that is fixed with respect to the respective rotary assembly 200. The tertiary rotation axes AT are in a secondary offset to the primary rotation axis AP. The rotary pistons 161A, 161B are axially flush with each other. A secondary bearing disk 214 of one the two rotary assemblies 200A, 200B is rotationally suspended inside a primary bearing disk 213 of one other of the two rotary assemblies 200A, 200B preferably via a disk interconnect bearing 241. The bearing disks 213, 214 have radial seal faces 223, 224 in rotating seal contact with each other. The primary bearing disk 213 has also peripheral seal face 225 in rotating seal contact with the housing 100. Seal faces 223, 224, 225 contribute in axially sealing the primary piston chamber 114.

Each of the rotary pistons 161A/161B features angled piston faces 165, a center face 164, and a peripheral face 166 with optional lubrication grooves 168. The peripheral face 166 provides preferably circumferential area contact sealing with a primary peripheral wall 116 of the primary piston chamber 114. Nevertheless and as may be well appreciated by anyone skilled in the art, the peripheral face 166 may feature other well known sealing features. Likewise, the center face 164 may be in a circumferential area contact sealing with a central seal wall 144 provided by a center tube 140. Optional well known seal features may also be employed on the center face 164.

Figure 6:
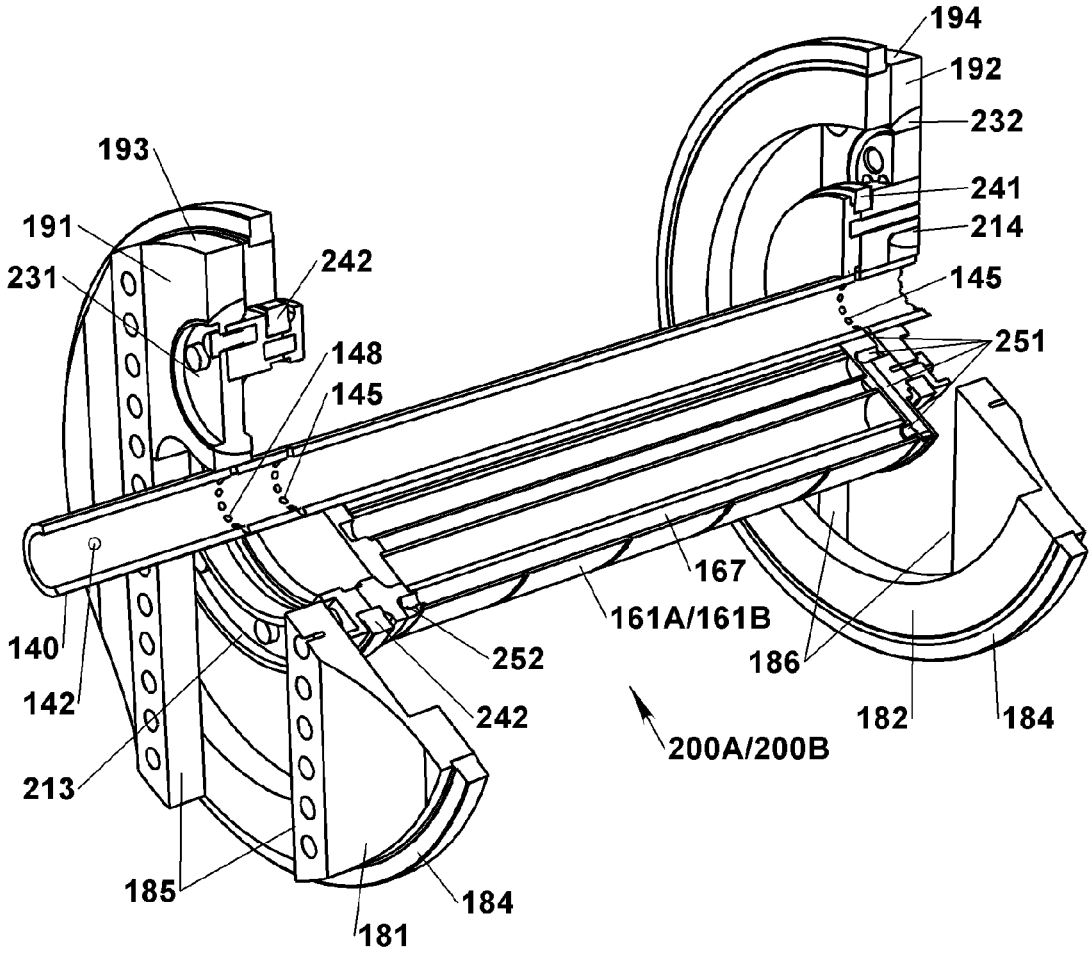
FIG. 6 is the first perspective view of the rotary assembly of FIG. 5 with drive pistons and fly wheels as in FIG. 3 in angled cut view.

Axial piston holes 1681 may serve as part of a lubricant supply channel to supply lubricant to the circumferential lubrication grooves 168. Each rotary piston 161A, 161B is preferably of an axially substantially continuous profile that may be fabricated by well known extrusion techniques. Axially substantially continuous means in the context of the present invention that axial discontinuities such as circumferential lubrication grooves 168, piston end seal lips 1693 and radial lubrication groove access holes 1681 are fabricated into the rotary pistons 161A/161B by material removal processes. The axial piston holes 1612, 167 are preferably through holes optionally also serving as part of a coolant transfer channel 251, 167, 252 as shown in FIG. 6.

Figure 8:
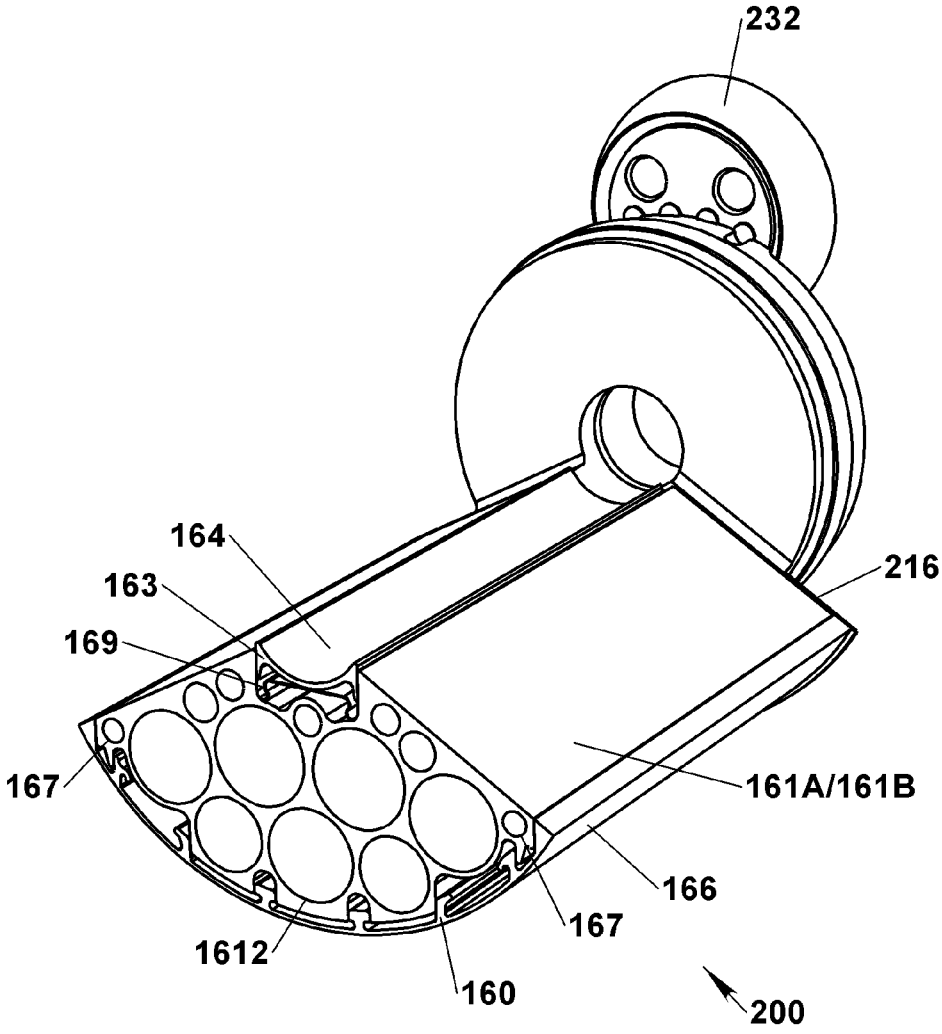
FIG. 8 is the second perspective view of the rotary assembly with a rotary piston of a second embodiment of the invention. The rotary assembly is cut along the vertical mid side plane.
Figure 9:
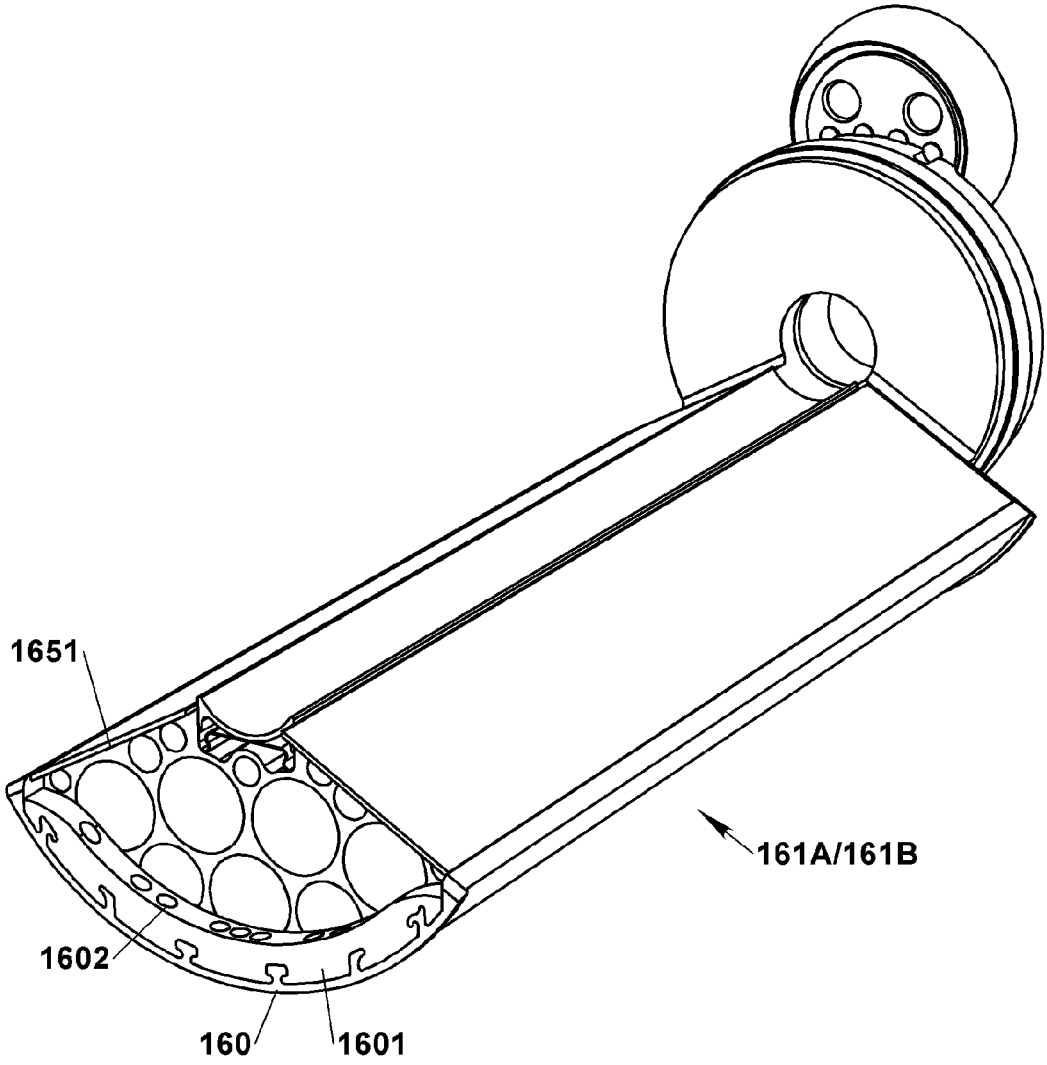
FIG. 9 is the second perspective view of the rotary assembly of FIG. 8 depicting the entire rotary piston.

In a second embodiment of the invention as depicted in FIGS. 8, 9, the rotary pistons 161A, 161B may each feature a peripheral seal profile 160 and center seal profile 163 that are both axially substantially flush with the respective rotary piston 161A/161B. Each peripheral seal profile 160 is radial outward sliding engaging with the respective rotary piston 161A/161B and features the peripheral contact face 166 configured for a snug sliding sealing contact with the primary peripheral wall 116. The center seal profile 163 may provide the center face 164 that is configured for a snug sliding sealing contact with the central seal wall 144. A radial spring profile 169 is springily interposed preferably between the respective rotary piston 161A/161B and the center seal profile 163 to resiliently press the center face 164 into contact with the central seal wall 144 in opposition to centrifugal forces. Nevertheless, the radial spring profile 169 and/or the like may be similarly springily interposed between the respective rotary piston 161A/161B and the peripheral seal profile 160. The peripheral seal profile 160 may be axially sliding interlocked at its axial ends with a stiffening rib 1601 that in turn may be radial coupled via radial pin holes 1602 with respective axial piston couplings 215, 216.

Center seal profile 163 and peripheral seal profile 160 provide area sealing irrespective eventual elastic radial deformation of the rotary piston 161A/161B due to centrifugal mass forces at high rotational speeds while the rotary pistons 161A/161B are radial fixed by the opposing axial piston coupling 215, 216 and while they are substantially free suspended in between them. The radial substantially free suspending of the rotary pistons 161A, 161B may contribute in transferring centrifugal mass forces of the rotary pistons 161A, 161B directly onto the respective crank disks 211, 212. Moreover and in the preferred case of the respective crank joints 231, 232 being diametrically opposite the axial piston couplings 215, 216 with respect to the primary rotation axis AP, a combined mass center MC of an individually driving rotary assemblies 200A/200B and its respective driving pistons 191, 192 may be predetermined to coincide with the primary rotation axis AP. In the second embodiment with the radial substantially free suspended rotary pistons 161A, 161B in conjunction with the combined mass center MC coinciding with the primary rotation axis AP, centrifugal mass forces of the rotary assembly 200 and the respective driving pistons 191, 192 may be substantially cancelled out within the rotary assembly 200. Only the centrifugal mass forces of the optional peripheral seal profile 160 and the optional stiffening rib 1601 may be transferred onto the housing 100. This may substantially reduce bearing loads on the disk interconnect bearings 241 and disk housing bearings 242 as well as vibration of the rotary piston device 100 at high rotational speeds. Disk housing bearings 242 are held in the housing 110 thereby defining the primary rotation axis AP for the rotary assemblies 200A, 200B, 200BA, 200BB of all three embodiments.

The two opposing flywheels 181, 182 are each positioned immediately outside and adjacent a respective bearing disk 213, 214. They are rotationally suspended via flywheel bearings 184 in the housing 110 thereby defining a secondary rotation axis AS for the flywheels 181, 182. The secondary rotation axis AS is stationary with respect to the housing 110 and in a primary offset OP to the primary rotation axis AP. Each of the two opposing flywheels 181/182 has a radial guide 185/186 in which two driving pistons 191/192 each belonging to a separate rotary assemblies 200A/200B are radial guided. The two opposing driving pistons 191,192 are joined with a respective crank joint 231,232 and rotationally suspended with respect to the tertiary rotation axis AT.

The flywheels 181, 182 rotate with a substantially constant secondary angular velocity together with the driving pistons 191, 192, which are radial held in constant distance to the primary rotation axis AP via the crank joints 231, 232. Hence, the driving pistons 191, 192 are once forced towards the secondary rotation axis AS and once forced back outwards during a single rotation of the flywheels 181, 182. As the driving pistons 191, 192 move radial back and forth, their primary angular velocities with respect to the primary rotation axis AP changes together with their respective joined rotary assembly 200A/200B. When the driving pistons 191, 192 are closest to the secondary rotation axis AS, the primary angular velocity of the rotary assembly 200 is at a minimum. When the driving pistons 191, 192 are at a maximum distance to the secondary rotation axis AS, their primary angular velocity of the rotary assembly is at a maximum.

Between their maximum and minimum primary angular velocities, the rotary assemblies 200A, 200B are once accelerated and once decelerated in an alternating fashion during a single flywheel 181, 182 rotation. This in turn results in alternating circumferential expansion and contraction of work volumes 111A, 111B that are encapsulated inside the primary piston chamber 114 in between the piston faces 165 and chamber seal faces 217, 218. Also, since one of the two rotary assemblies 200A, 200B together with its driving pistons 191, 192 is accelerated substantially at the same rate as the other one of the two rotary assemblies 200A, 200B with its driving pistons 191, 192 is decelerated, their respective angular mass forces substantially cancel each other out at radial guides 185, 186. This contributes to a steady rotational speed of the flywheels 181, 182 as may be well appreciated by anyone skilled in the art.

Figure 7:
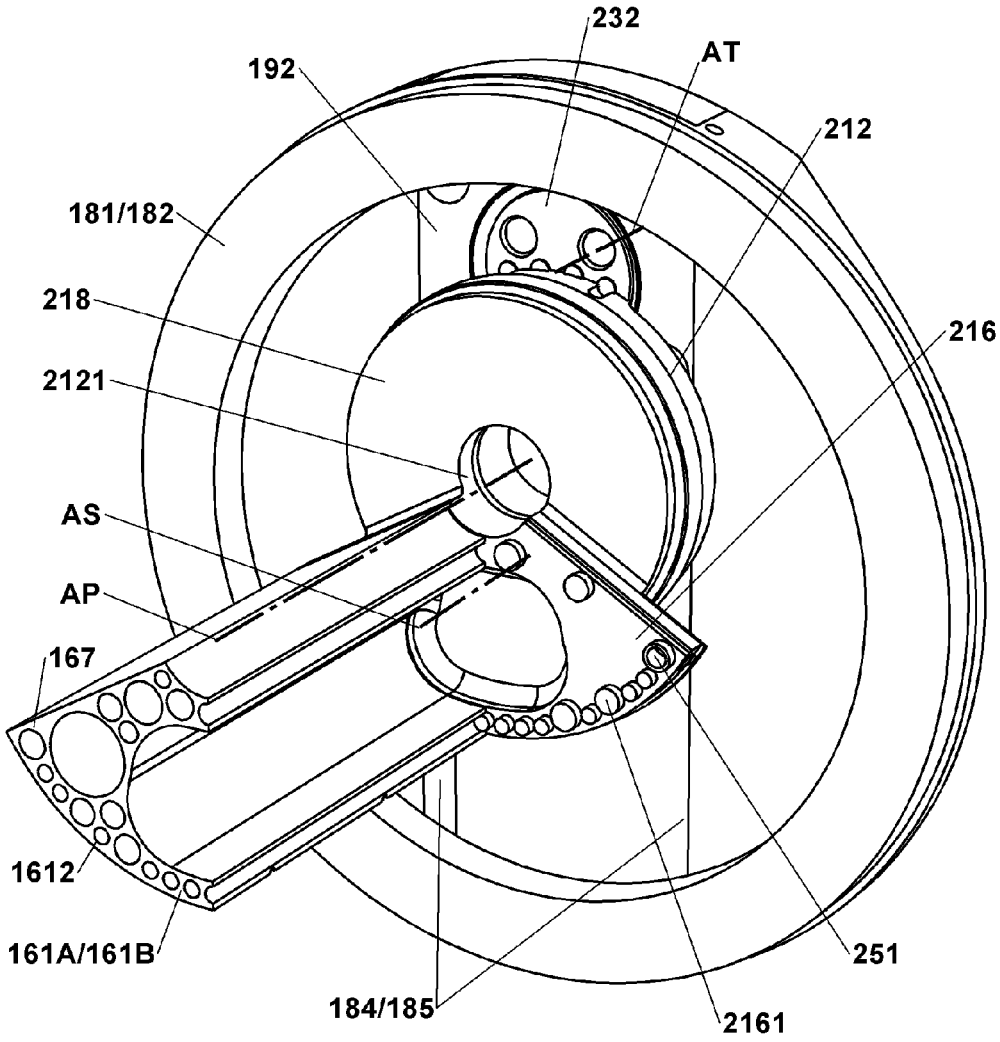
FIG. 7 is a second perspective view of the rotary assembly, one drive piston and one fly wheel as in FIG. 6. The rotary piston is cut along the vertical mid side plane and the vertical mid front plane.

The two opposing crank disks 213, 214 are preferably torque coupled across rotary pistons 161A, 161B and consequently the opposing flywheels 181, 182 are also rotationally coupled across the driving pistons 191, 192 and across the rotary assemblies 200A, 200B. As depicted in FIG. 7, torque coupling of the rotary pistons 161A, 161B with the axial piston couplings 215, 216 is accomplished by coupling protrusions 2161 that preferably axially loose interlock with through holes 1612, 167 of the rotary pistons 161A, 161B. The interlocking of the coupling protrusions 2161 with the through holes 1612, 167 may be rigid in radial direction in the second embodiment and may be radial rigid or loose in the first embodiment by predetermined radial interlock tolerances as may be well appreciated by anyone skilled in the art.

Each of the two assemblies 200A, 200B preferably features one primary bearing disk 213 and one secondary bearing disk 214 such that the two rotary assemblies 200A, 200B are intertwined around the primary rotation axis AP. In that case, a radial supply channel 251 may extend radial outward inside the secondary bearing disk 214 from a center tube hole 2121 up to an axial piston hole 167. A radial supply channel such as depicted supply channel 251 and an axial piston hole such as piston hole 167 may be part of a lubricant supply channel that supplies lubricant to the lubrication grooves 168 on the peripheral piston face 166. Radial lubrication groove access holes 1681 may be connecting for that purpose the outside lubrication grooves 168 with the inside of a corresponding axial piston hole. The axial piston hole 167 may be a through hole and connected with a radial drain channel 252 extending outward from the axial piston hole 167 in the primary bearing disk 213. Radial supply channel 251, axial through hole 167 and radial drain channel 252 may be part of a coolant transfer channel through which coolant may be transferred through the rotary pistons 161A, 161B. The axial coolant through holes 167 are preferably in proximity to the peripheral edges of the piston faces 165 where maximum heat transfer with the work fluid during its intake and/or exhaust may occur. Coolant and/or lubricant exiting the rotary assemblies 200A, 200B may be captured by drain grooves in the peripheral wall 116 as may be well appreciated by anyone skilled in the art.

A piston slider 170 axially extending along the primary rotation axis AP and substantially flush with the rotary pistons 161A, 161B may be circumferential positioned at the primary piston chamber 114, where the rotary pistons 161A, 161B pass by in closest proximity and where the work volumes 111A/111B are at a minimum. The piston slider 170 may skim the peripheral piston faces 166 from lubricant and/or coolant while at the same time providing a sealing barrier between oppositely adjacent high pressure fluid access 130 and low pressure fluid access 120.

Also held in the housing 110 is a center tube 140 that is concentric with respect to and axially extending along the primary rotation axis AP. The center tube 140 is inserted from at one side of the housing 110 and extends through the opposing flywheels 181, 182, through center tube holes 2121 in the secondary bearing disks all the way across the rotary assemblies 200A, 200B. The center tube 140 has an axial service fluid channel 142 in communication with circumferential assembly supply holes 145, which in turn are axially aligned and in rotationally free communication with the service fluid channel 251, 167, 252 and the like lubrication channel. Likewise, the center tube 140 may feature driving piston supply holes 148, that supply the interfaces between driving pistons 191, 192 and radial guides 185 as well as crank joints 231, 231 with lubricant and/or coolant. Since the flywheels 181, 182 are torque coupled via driving pistons 191, 192 and rotary assemblies 200A, 200B, the center tube 140 may be conveniently utilized for coolant and lubricant supply at the location otherwise occupied by central torque transmitting shafts well known in the prior art.

Referring to FIGS. 10-18 and in accordance with a third embodiment of the invention, secondary rotary assemblies 200BA, 200BB may be axially connected with each of the rotary assemblies 200A, 200B at one of the crank joints 231, 232 combined in a central crank joint 233. A central driving piston 195 may be joined to the central crank joint 233. The connection is preferably such that a primary bearing disk 213 is facing a secondary bearing disk 214 at the central crank joints 233. The crank joints 231, 232, 233 may be preferably configured with spherical bearing surfaces such that elastic angular deformation in the crank joints 231, 232, 233 due to torque transfer, angular mass force cancellation, and local centrifugal mass forces is not transferred onto the driving pistons 191, 192, 195. Thereby peak contact pressures in the bearing interfaces between driving pistons 191, 192, 195 and crank joints 231, 232, 233 as well as between driving pistons 191, 192, 195 and radial guides 185, 186 may be substantially avoided. The central driving pistons 195 may be axially segmented such that the central crank joint 233 may be sandwiched in between the axial segments of the central driving piston 195.

Figure 11:
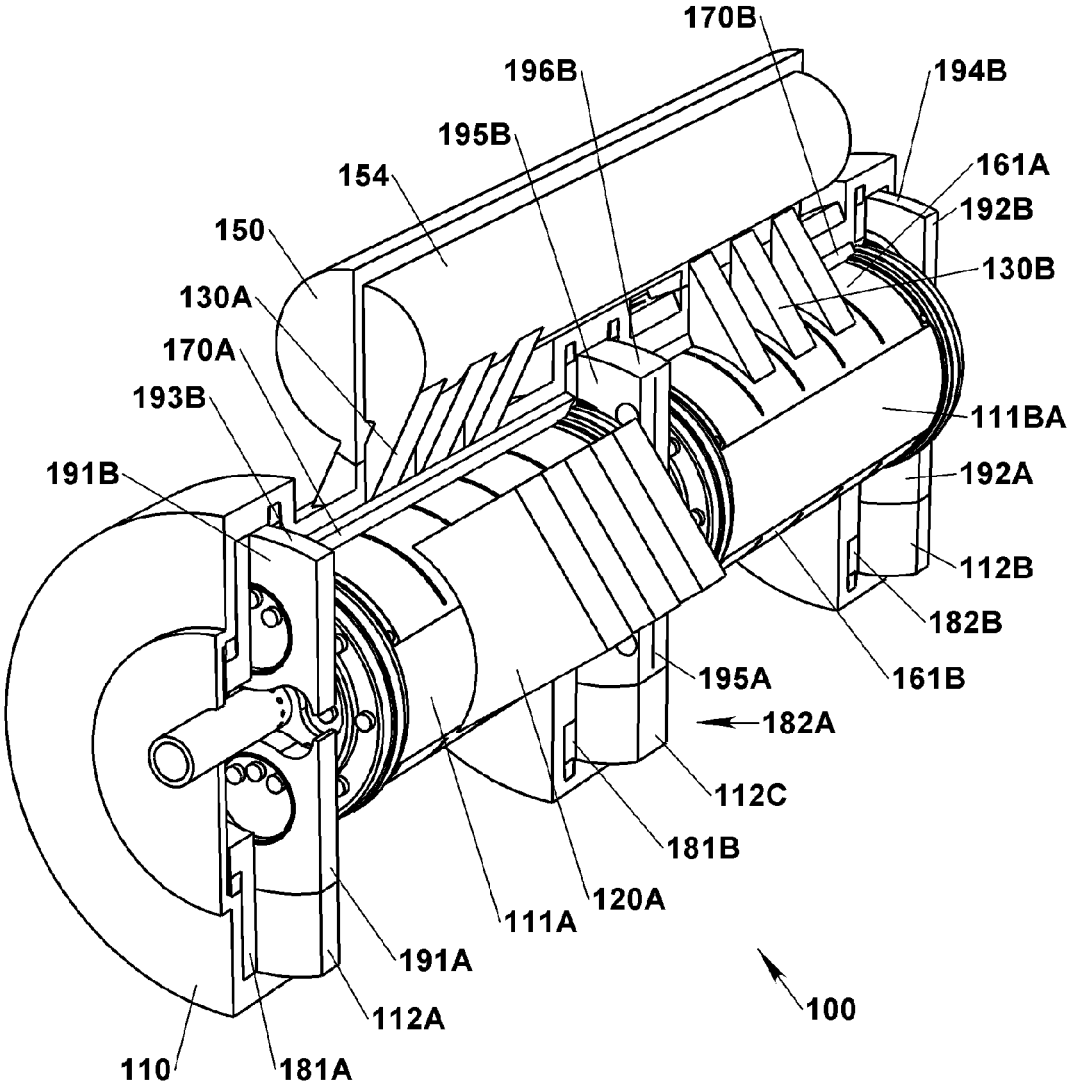
FIG. 11 is the second perspective view of the third embodiment rotary piston device with the housing and flywheels cut along the vertical mid front plane. Depicted as solids are also work volumes and fluid accesses and a combustion volume as provided in the third embodiment.
Figure 12:
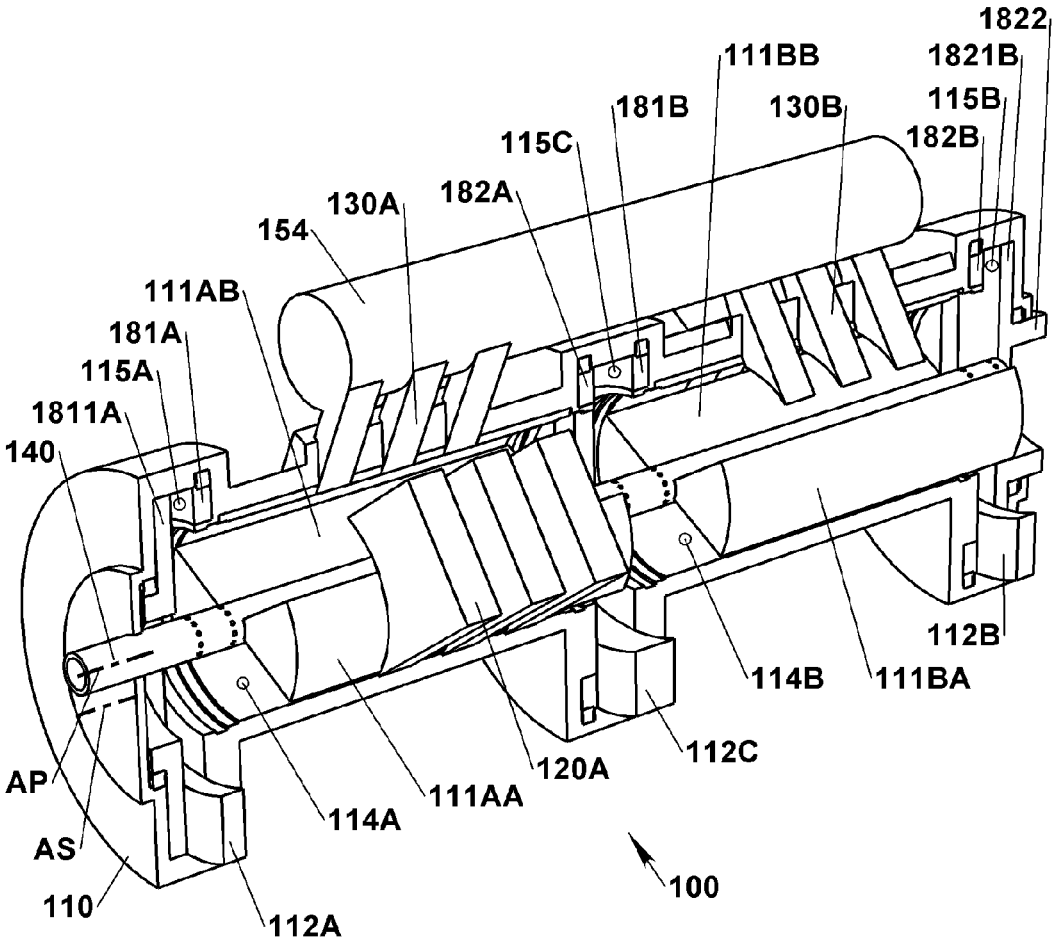
FIG. 12 is the first perspective view of the third embodiment as in FIG. 11 without doubled rotary assemblies and without driving pistons.

FIGS. 11, 12 depict the rotary piston device 100 of the third embodiment including the housing 110. Primary piston volumes 111A, 111BA as well as low pressure accesses 120A, 120B, high pressure accesses 130A, 130B and fluid transfer volume 154 in the preferred configuration as a combustion volume are depicted as solids. The driving pistons 191, 192 may contribute with their radial piston faces 193A, 193B, 194A, 194B in encapsulating secondary work volumes 112A, 112B, 112C in between the radial guides 185, 186, the respective flywheels 181, 182 and within secondary piston chambers 115A, 115B, 115C. The secondary piston chambers 115A, 115B, 115C are concentric with respect to secondary rotation axis AS. The flywheels 181, 182 rotate within the secondary piston chambers 115A, 115B, 115C. The bearing disks 213, 214 axially separate the primary piston chamber(s) 114A, 114B from the secondary piston chambers 115A, 115B, 115C. Central piston faces 196 of the central driving pistons 195 may contribute to encapsulate central secondary work volumes 112C as described for secondary work volumes 112A, 112B. The central work volumes 112C may be preferably utilized to receive combusting fluid.

Figure 19A:
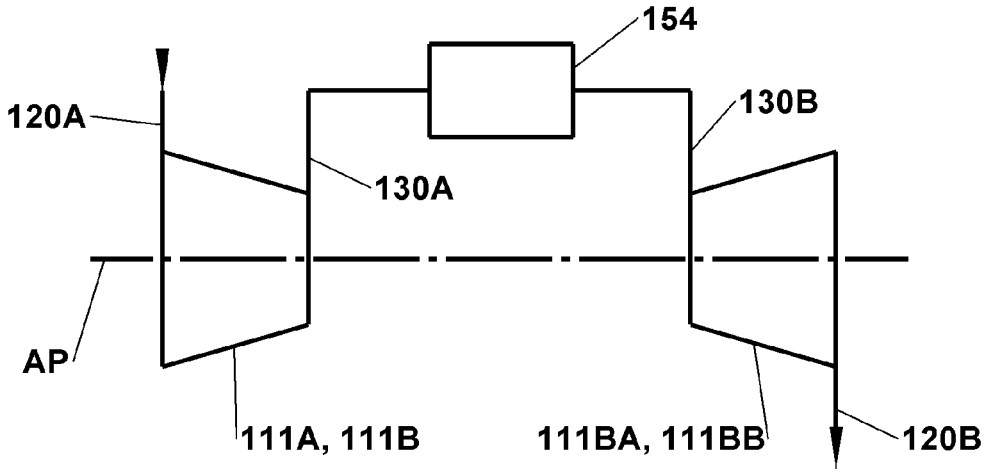
FIG. 19A depicts an operation schematic of a single stage engine configuration of the rotary piston device.
Figure 19B:
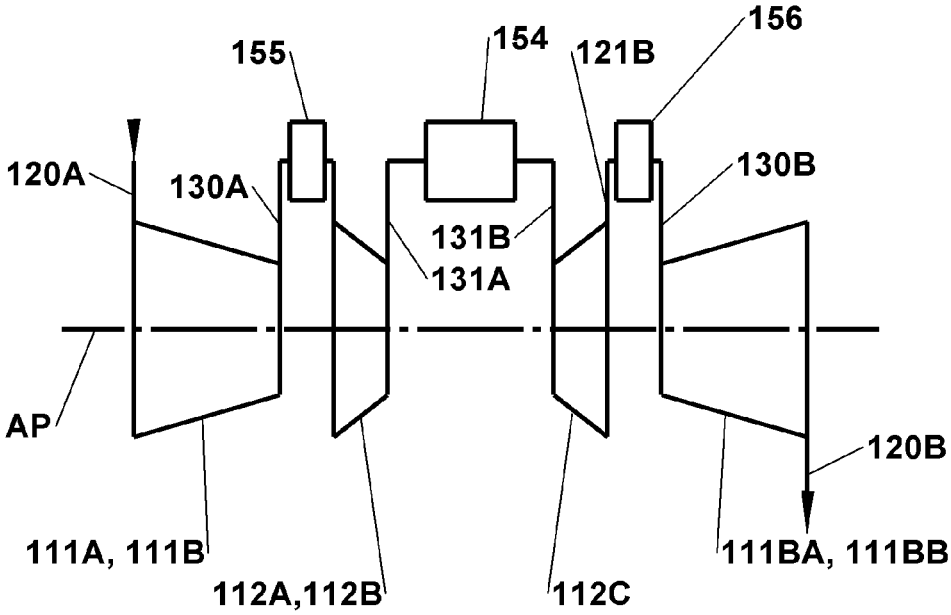
FIG. 19B depicts an operation schematic of a dual stage engine configuration of the rotary piston device.

The rotary piston device 100 may be utilized to compress fluid or to derive mechanical energy from compressed fluid as a motor. In the third embodiment, a compression stage may be conveniently combined with a motor stage and the entire rotary device 100 may operate as a combustion engine in which compressed air and/or air/fuel mixture is thermally energized in a well known fashion after exiting primary work volumes 111A, 111B in a pressurized condition and before or while entering secondary work volumes 111BA, 111BB through secondary pressure fluid access 130B. For that purpose, the fluid transfer housing 150 may be configured as a well known combustion chamber. The third embodiment rotary piston device 100 may be operated as single stage combustion engine as schematically depicted in FIG. 19A or as a dual stage combustion engine as schematically depicted in FIG. 19B. In the single stage operation, work fluid such as air and/or air/fuel mixture is compressed in a single stage prior to combustion and expanded in a singe stage following and/or during combustion of the air/fuel mixture. In the dual stage operation, fluid compression may be performed initially in the circumferential changing work volumes 111A, 111B that are a multiple of the radial changing work volumes 112A, 112B while both are maximum expanded. In a fluid cooler 155 placed along a fluid transfer channel between initial compression stage and final compression stage, the initially compressed fluid may be cooled down before entering the secondary piston chamber(s) 115A and/or 115B and before being compressed a second time. Fluid expansion may also be separated into two stages with the initial high pressure expansion preferably taking place in the central secondary piston chamber 115C, where double bearing disk support of each central crank joint 233 may handle higher fluid pressures. Breaking up the expansion of the combusting air/fuel mixture into two stages provides for additional combustion reaction time before entering the final expansion stage again in a primary combustion chamber 114B. For that purpose, a reactor 156 may be placed along a fluid transfer channel between high pressure and low pressure expansion stages.

The scope of the invention is not limited to a particular dimensional relation of primary offset OP and secondary OS. Nevertheless and as depicted, the primary offset OP may be about half the secondary offset OS and the angular extension of the rotary pistons 161A, 161B around the primary rotation axis AP may be about 120 degrees. In that case, the rotary pistons 161A, 161B are in closest proximity to each other and the work volumes 111A, 111B, 111BA, 111BB may be about zero in an angular position of the radial guides 185 as depicted for work volumes 111B, 111BB in FIG. 13. A dead volume well known in the prior art may be thereby substantially avoided. At that angular flywheel 181, 182 orientation, the radial guides 185, 186 are about perpendicular to an axis plane PL that coincides with primary rotation axis AP and secondary rotation axis AS. Also at that angular orientation, both intertwined rotary assemblies 200A, 200BA and 200B, 200BB have maximum angular acceleration and deceleration respectively and the same angular velocity as the flywheels 181, 182. The piston sliders 170 are positioned also such that they contact the piston faces 166 while coinciding with the axis plane PL.

Figure 13:
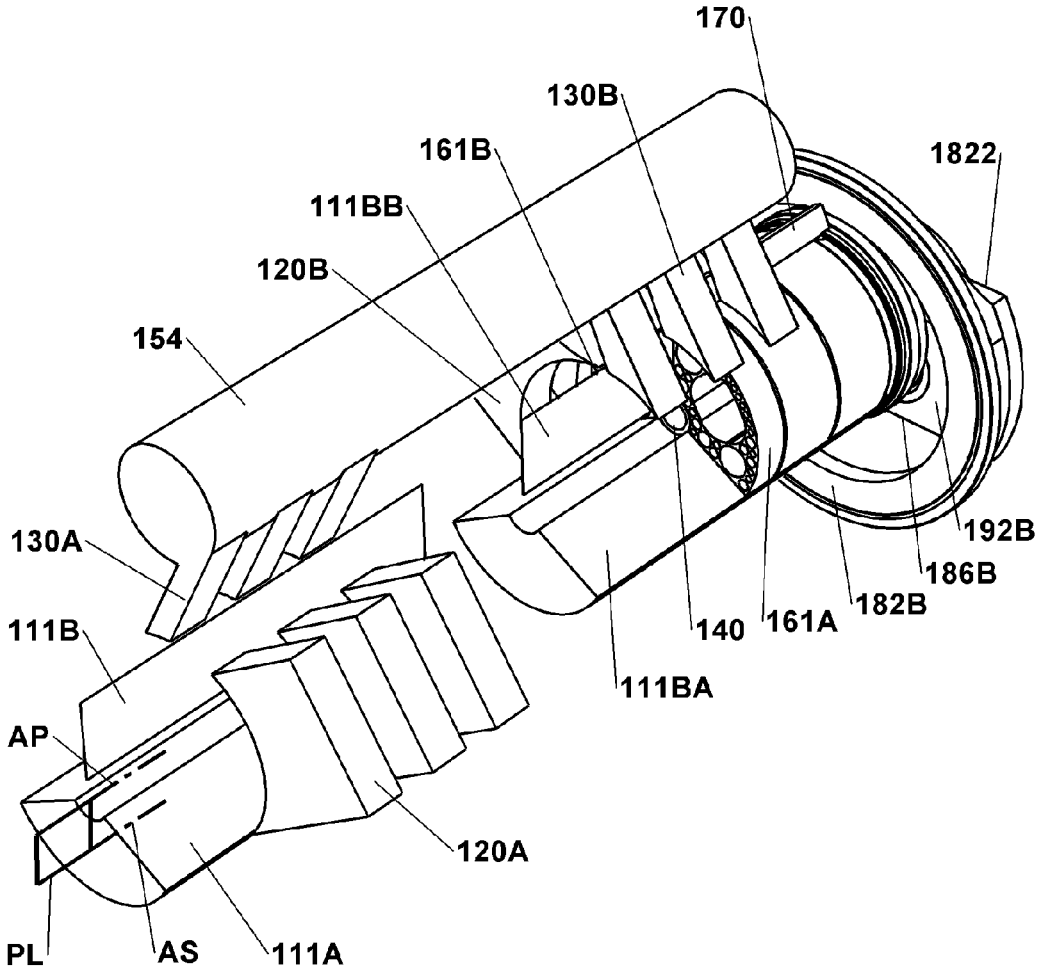
FIG. 13 is a third perspective view of the work fluid volumes and channels at a first angular flywheel position. The doubled rotary assemblies are cut along a rear vertical mid side plane.
Figure 14:
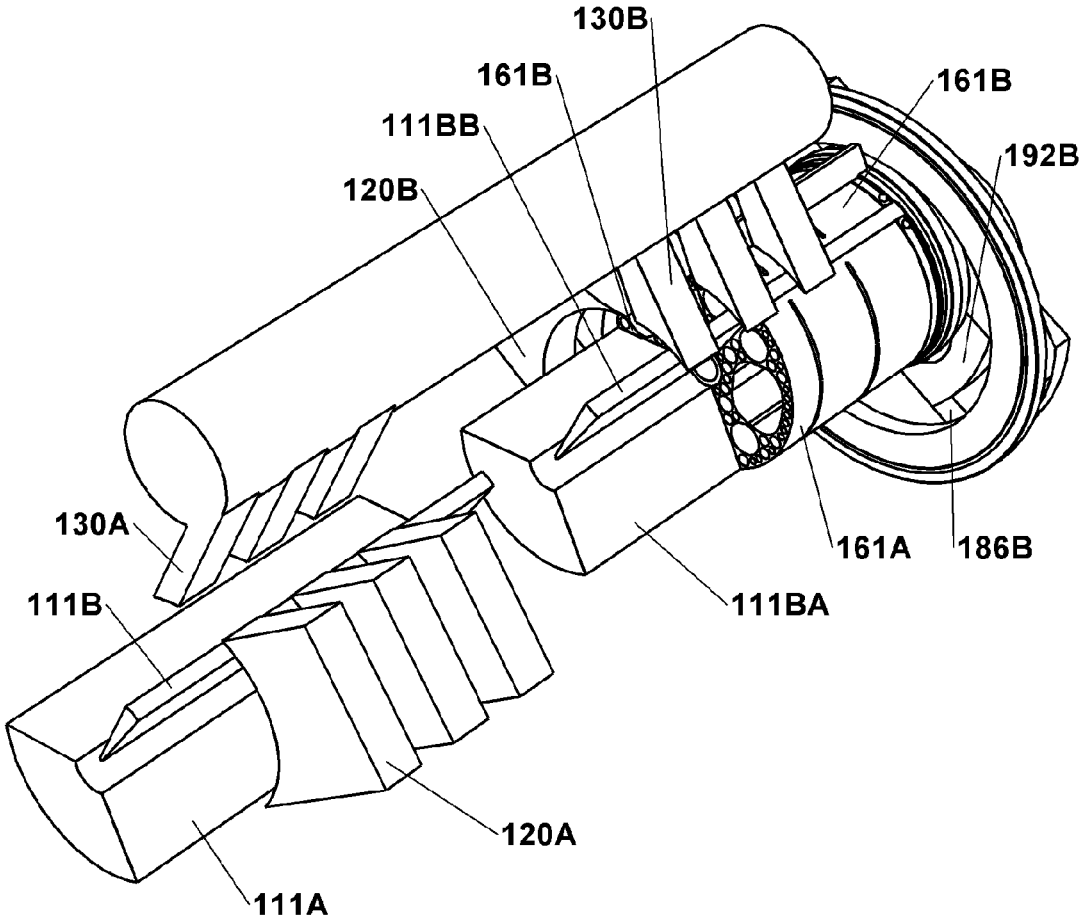
FIG. 14 is the third perspective view as in FIG. 13 at a second angular flywheel position in a 30 deg angle to the first angular flywheel position.
Figure 15:
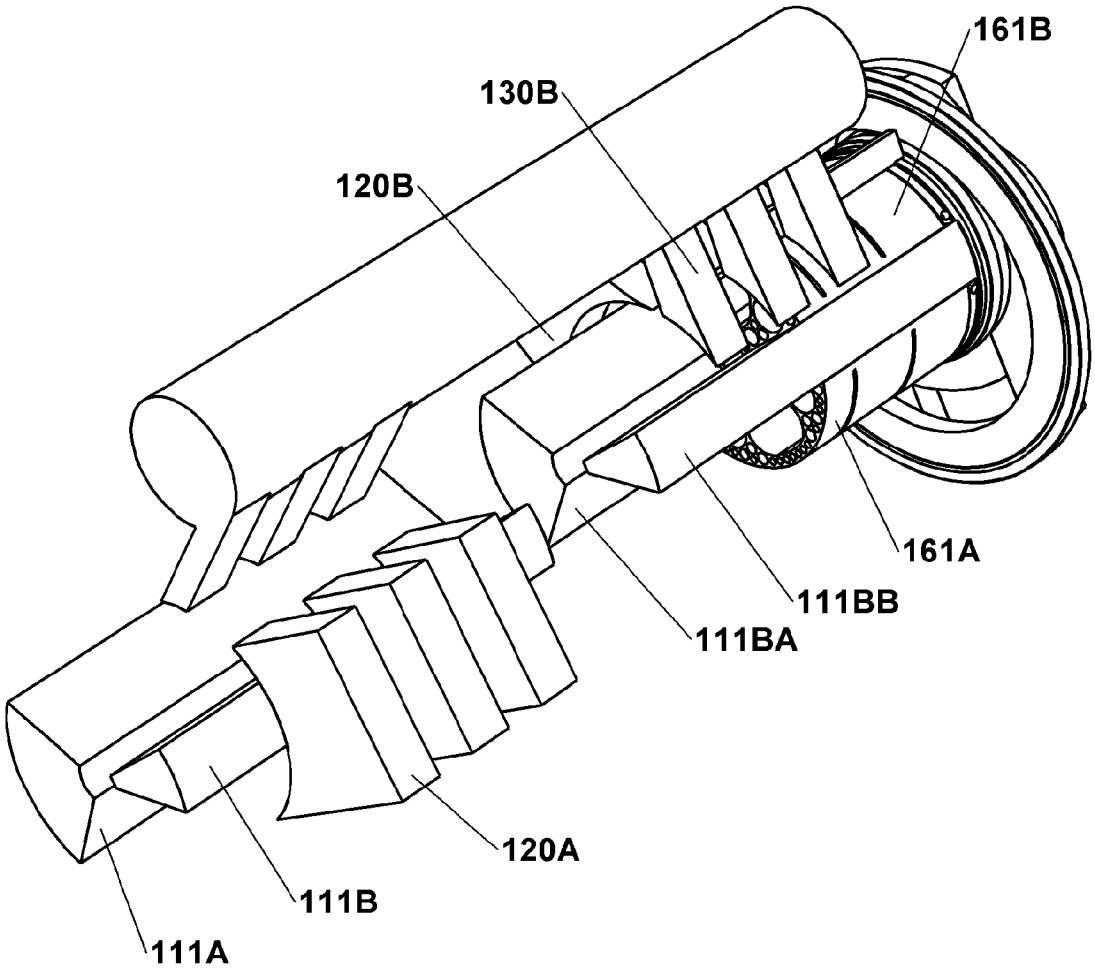
FIG. 15 is the third perspective view as in FIG. 13 at a third angular flywheel position in a 30 deg angle to the second angular flywheel position.
Figure 16:
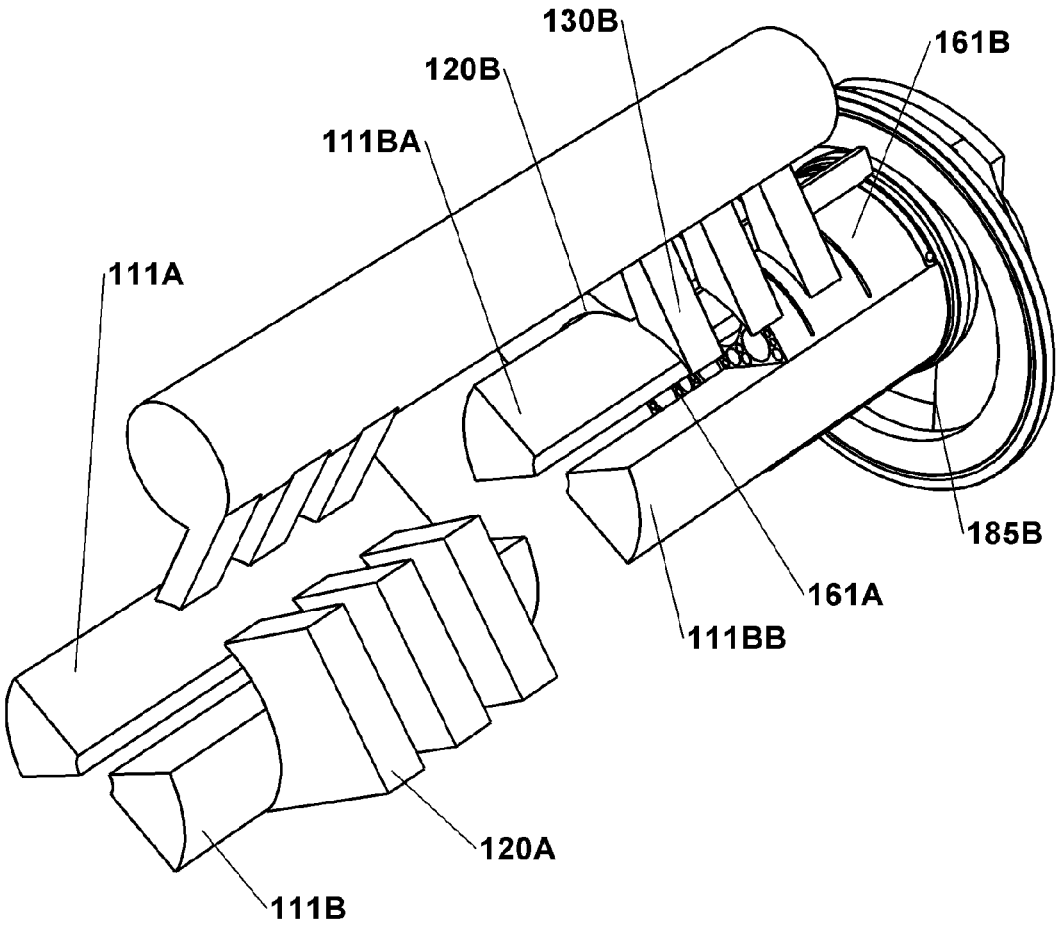
FIG. 16 is the third perspective view as in FIG. 13 at a fourth angular flywheel position in a 30 deg angle to the third angular flywheel position.
Figure 17:
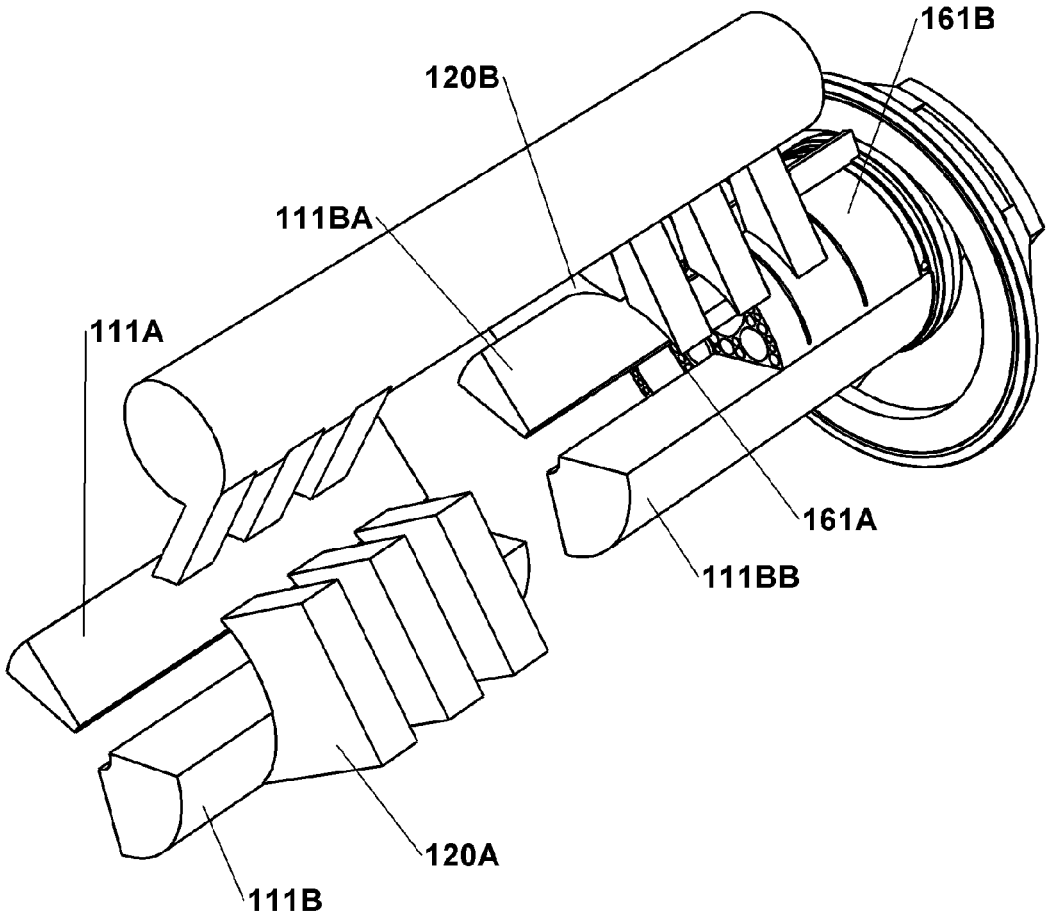
FIG. 17 is the third perspective view as in FIG. 13 at a fifth angular flywheel position in a 30 deg angle to the fourth angular flywheel position.
Figure 18:
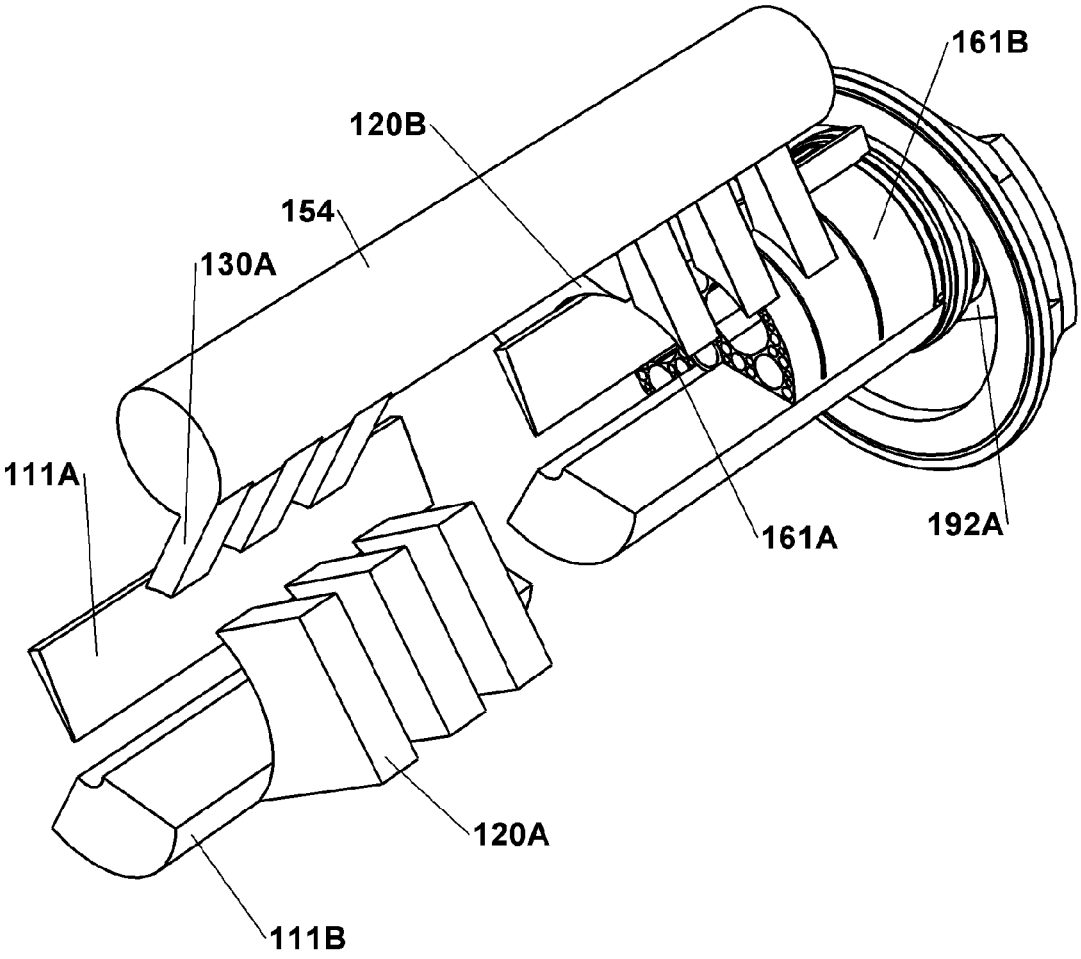
FIG. 18 is the third perspective view as in FIG. 13 at a sixth angular flywheel position in a 30 deg angle to the fifth angular flywheel position.

As the flywheels 181, 182 continue to rotate, the depicted driving piston 192B moves closer to the secondary rotation axis AS thereby reducing its primary angular velocity together with the rotary piston 161B and its equivalent rotary assembly while the other intertwined rotary assembly with its depicted rotary piston 161A is accelerated at the same rate. Consequently, work volumes 111B, 111BB expand, while work volumes 111A, 111BA contract. This is depicted in the FIGS. 14-18 with 30 deg rotationally increments of the flywheels 181, 182. In FIG. 13, the work volume 111B just got out of access with high pressure access 130A after its contained pressurized air and/or air/fuel mixture was transferred to the combustion volume 154. Pressure rise due to combustion in the closed combustion volume 154 may occur. In FIG. 14, work volume 111BB receives combusting air/fuel mixture via high pressure accesses 103B while work volume 111B opens up to low pressure access 120A and receives low pressure ambient air and/or fuel air mixture. Work volume 111A is contracting and pressurizing the contained air and/or air/fuel mixture. Work volume 111BA is accessed by low pressure access 120B and releasing the contained expanded combusted air/fuel mixture. In FIGS. 15-18, work volume 111BB is out of access with high pressure access 130B while work volume 111B is still accessed by low pressure access 120A and work volume 111BA is still accessed by low pressure access 120B. In FIG. 18, the work volume 111A is about to release the contained air and/or air/fuel mixture into the high pressure access 130A and the combustion chamber 154.

Figure 10:
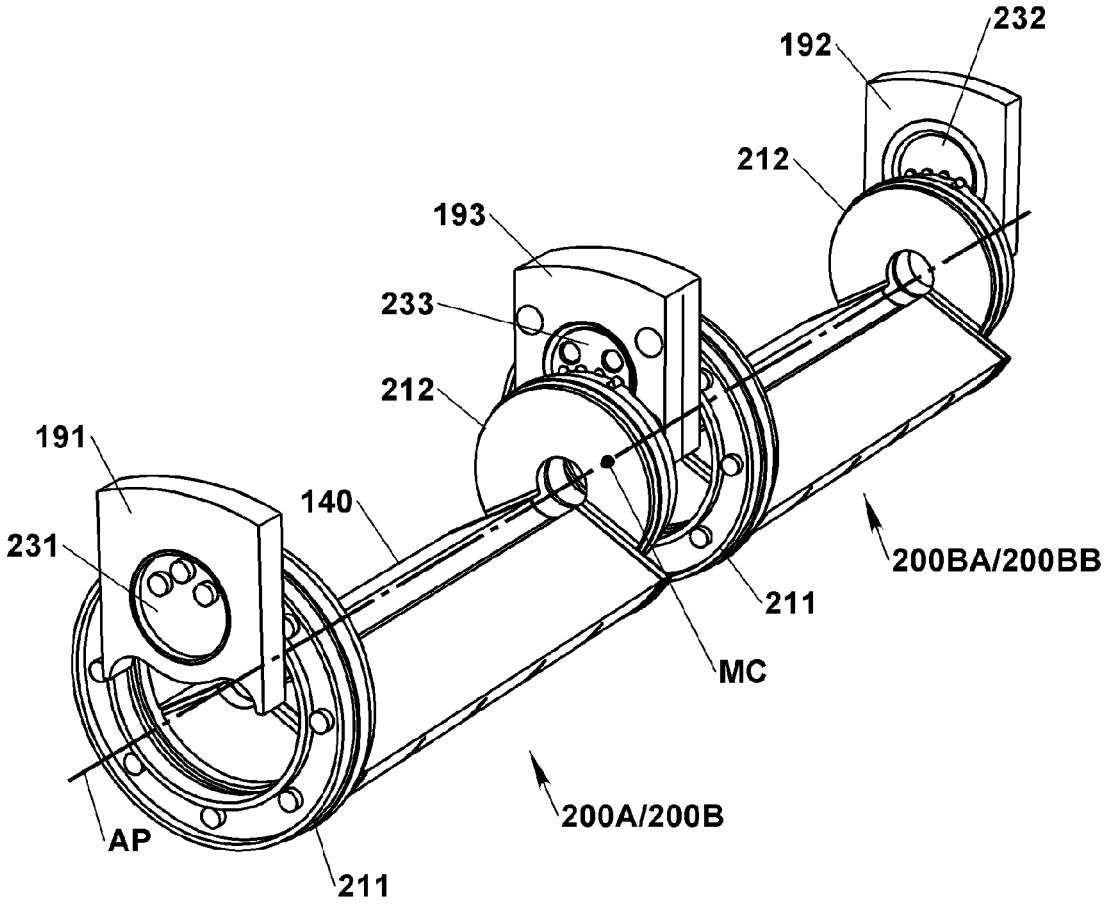
FIG. 10 is the second perspective view of a doubled rotary assembly of a third embodiment of the invention.

In a best mode anticipated by the inventor at the time of filing this invention, a single stage rotary piston device 100 similar as depicted in the FIGS. 10-12 may be designed with rotary pistons 161A, 161B being about 200 mm long with peripheral wall 116 diameter of about 100 mm and center tube 140 diameter of about 20 mm. The work volumes 111A, 111B at their maximum circumferential expansion measure about 0.5 liter such that during one full rotation of the flywheels 181, 182 about 1 liter of fluid transfer volume is provided. Crank joints 231, 232, 233 and crank joint adjacent portions of the bearing disks 231, 232 as well as bolts and sheer pins inside the flywheels 181, 182 and bearing disks 231 232 may be of alloy steel. The remaining parts may be of high strength aluminum alloy. The primary offset OP is about 17.5 mm and the secondary offset OS about 35 mm. Full complement ball bearings are used for bearings 241, 242, 184.

The mass of each doubled rotary assembly 200A+200BA, 200B+200BB including its respective driving pistons 191, 192, 195 is about 2.3 kg with their respective combined mass centers MC substantially coinciding with the primary rotation axis AP.

The below nomenclature is included as reference. Numerals in the Specification and Figures may have a letter extension where multiples of the same numerically referenced components are identified.

100 Rotary piston device
110 Housing
111 Circumferential changing work volumes
112 Radial changing work volumes
114/115 Primary/Secondary Piston chamber
116 Peripheral primary piston chamber wall
120 Low pressure fluid access
130 High pressure fluid access
140 Center tube
142 Axial service fluid channel
144 Central seal wall
145 Circumferential assembly supply holes
148 Driving piston supply holes
150 Fluid transfer housing
154 Fluid heating volume
155 Fluid cooler
156 Reactor
160 Peripheral seal profile
1601 Stiffening rib
1602 Radial pin holes
161A, 161B Rotary pistons
1612 Through holes
163 Center seal profile
164 Center face
165 Piston faces
166 Peripheral piston face
167 Axial fluid hole
168 Circumferential lubrication grooves
1681 Radial lubrication groove access holes
169 Radial spring profile
1691, 1692 Opposing axial piston ends
1693 Piston end seal lips
170 Piston slider
181, 182 Flywheels
184 Flywheel bearings
185/186 Radial guides
191/192 Driving pistons
195 Central driving piston
193/194 Radial piston faces
196 Central piston face
200 Rotary assembly
211, 212 Crank disks
2121 Center tube hole
213, 214 Primary/Secondary bearing disk
215, 216 Axial piston coupling
2161 Coupling protrusions
217, 218 Chamber seal faces

219, 220 Coupling back faces
223, 224 Radial seal faces
225 Peripheral seal face
226 Central disk seal face
231, 232 Crank joint
233 Central crank joint
241 Disk interconnect bearing
242 Disk housing bearing
251 Radial supply channel
252 Radial drain channel
AP Primary rotation axis
AS Secondary rotation axis
AT Tertiary rotation axis
PL Axis plane
MC Combined mass center Accordingly, the scope of the invention as described in the Figures and the Specification above is set forth by the following claims and their legal equivalent:

What is claimed is:

1. A rotary piston device comprising:

A. a housing;

B. a piston chamber that is inside said housing, said piston chamber being rotationally symmetric with respect to a primary rotation axis that is stationary with respect to said housing;

C. at least two rotary assemblies each individually rotationally suspended with respect to said primary rotation axis within said piston chamber, at least one of said rotary assemblies comprising:

i. a rotary piston axially extending along said primary rotation axis between two opposing axial piston ends;

ii. two opposing crank disks each comprising:

a. an axial piston coupling that is engaging with a respective one of said two opposing axial piston ends;

b. a crank joint providing a tertiary rotation axis that is fixed with respect to said rotary assembly and in a secondary offset to said primary rotation axis;

c. one of a primary bearing disk and a secondary bearing disk located in between said axial piston coupling and said crank joint;

D. two opposing flywheels each outside adjacent said primary and secondary bearing disks, said two opposing flywheels being rotationally suspended with respect to a secondary rotation axis in said housing, wherein said secondary rotation axis is stationary with respect to said housing and in a primary offset to said primary rotation axis, each of said two opposing flywheels comprising a radial guide; and E. two opposing driving pistons per said at least one of said rotary assemblies, each of said two opposing driving pistons joined with a respective one of said crank joints and rotationally suspended with respect to said tertiary rotation axis while being radial guided by a respective one of said radial guides; and wherein:

said secondary bearing disk of one of said rotary assemblies is rotationally suspended concentrically inside said primary bearing disk of one other of said rotary assemblies.

2. The rotary piston device of claim 1, wherein said two opposing flywheels are rotationally coupled across at least one of said rotary assemblies.

3. The rotary piston device of claim 1, further comprising a radial supply channel that is extending radial outward inside said secondary bearing disk up to an axial piston hole.

4. The rotary piston device of claim 3, wherein said axial piston hole is part of a lubricant supply channel.

5. The rotary piston device of claim 3, wherein said axial piston hole is a through hole connected to a radial drain channel that is extending radial outward from said axial piston hole in said primary bearing disk.

6. The rotary piston device of claim 3, wherein said axial piston hole is part of a coolant transfer channel.

7. The rotary piston device of claim 1, further comprising a piston slider axially extending along said primary rotation axis and substantially flush with said rotary pistons, said piston slider being circumferential positioned at said piston chamber where said rotary pistons pass by in closest proximity.

8. The rotary piston device of claim 1, further comprising a center tube concentrically to and axially extending along said primary rotation axis and through said two opposing flywheels and said piston chamber.

9. The rotary piston device of claim 8, wherein said center tube comprises an axial service fluid channel and a circumferential assembly supply hole in communication with said axial service fluid channel, said circumferential assembly supply hole being axially aligned and in rotationally free communication with a service fluid channel of at least one of said rotary assemblies.

10. The rotary piston device of claim 1, wherein said crank joints are diametrically opposite said axial piston couplings with respect to said primary rotation axis and wherein a combined mass center of said at least one of said rotary assemblies and respective said two opposing driving pistons substantially coincides with said primary rotation axis.

11. The rotary piston device of claim 1, wherein said crank joint comprises a spherical bearing surface.

12. The rotary piston device of claim 1, wherein said rotary piston comprises an axially substantially continuous profile.

13. The rotary piston device of claim 1, wherein said primary offset is about half said secondary offset and wherein an angular extension of said rotary piston around said primary rotation axis is about 120 degrees.

14. The rotary piston device of claim 1, wherein said rotary piston is axially free held by said axial piston coupling.

15. The rotary piston device of claim 1, further comprising a combustion chamber in fluid communication with said piston chamber.

16. The rotary piston device of claim 1, further comprising a fluid cooler in fluid communication with said piston chamber.

17. The rotary piston device of claim 1, further comprising a reactor in fluid communication with said piston chamber.

18. The rotary piston device of claim 1 being a compression stage of a combustion engine.

19. The rotary piston device of claim 1 being an expansion stage of a combustion engine.

* * * * *